US005117514A

United States Patent [19]

Richter

[11] Patent Number: 5,117,514

[45] Date of Patent: Jun. 2, 1992

[54] IMPROVED TOILET-TANK FLAPPER VALVE

[76] Inventor: Robert A. Richter, 1231 Golden Rain Rd. #70G, Seal Beach, Calif. 90740

[21] Appl. No.: 695,967

[22] Filed: May 6, 1991

[51] Int. Cl.[5] ..... E03D 1/34

[52] U.S. Cl. ..... 4/393; 251/228; 251/294; 251/299

[58] Field of Search ..... 4/324, 325, 392, 393, 4/403, 404, 415, 394-397, 401, 402; 251/228, 294, 299, 358

[56] References Cited

U.S. PATENT DOCUMENTS

| | | | |
|---|---|---|---|
| 1,006,964 | 10/1911 | Lyons | 251/358 |
| 1,072,004 | 9/1913 | Hart | 251/358 |
| 1,255,090 | 1/1918 | Gally | 251/358 X |
| 1,352,735 | 9/1920 | Egerton | 251/358 |
| 4,467,482 | 8/1984 | Dyer | 4/395 X |
| 4,499,616 | 2/1985 | Johnson | 4/393 |

*Primary Examiner*—Charles E. Phillips

*Attorney, Agent, or Firm*—Albert O. Cota

[57] ABSTRACT

An improved toilet flapper valve (10) designed to directly replace either a conventional toilet flapper valve or tank ball valve. The valve (10) allows a toilet user to selectively determine the quantity of water used for a toilet flush by controlling the time that a toilet flush handle (38) is held in the depressed position. The water quantity used depends on whether liquid or solid waste is to be flushed. For liquid waste, a partial flush is used; for solid waste a full flush is recommended. The valve (10) consists of a resilient body having a cavity (12) located over the toilet tank drain (34). The cavity houses a weight (16) that fulfills two functions: it provides the weight necessary to make the valve non-buoyant and it produces under the area of the weight, a flat rigid section (18) that extends radially over and beyond the perimeter of the valve seat (36). This rigid section provides a positive seal without sagging which can produce unnoticed leaks.

9 Claims, 2 Drawing Sheets

IMPROVED TOILET-TANK FLAPPER VALVE

TECHNICAL FIELD

The invention pertains to the general field of toilet flushing systems and more particularly to a flushing system that uses an improved toilet-tank flapper valve that allows the user to select the quantity of water to be used for the flush.

BACKGROUND ART

Most toilets in use today, consist of two main parts; an upper part which holds water, referred to as a tank section, and a lower part consisting primarily of a bowl with a volume of water which is designed to receive human waste products. Once the waste products have been deposited in the bowl, they are removed by releasing the water held in the upper tank section into the bowl. The released water removes the waste products to a collection system, such as a sewer system or a septic tank, and then refills the bowl so that there remains standing a volume of water. Waste products consist of solid and liquid wastes and in presently available toilets, one full flush is normally utilized to carry away both solid and liquid wastes, even when there is only liquid waste in the toilet bowl. In these standard toilets, a full complete flush is effected with each flush and the total contents of the water in the tank section is drained into the bowl and then out into the sewer system.

One of the most often used toilet flushing systems comprises a ball-cock valve assembly that controls the inlet of water into the tank section. A float ball is connected to the ball-cock valve by means of a float arm. As the toilet tank fills with water, the buoyant float ball rises in the tank section. The motion of the float ball is transmitted to the ball-cock through the float arm until at a predetermined water level the ball-cock assembly shuts off the water inlet to the tank. This corresponds to a generally horizontal position of the float arm. In most toilets, the water level in the water tank may be adjusted by means of a screw set mechanism provided in the ball-cock assembly. This adjustment, however, is limited in range and requires that the tank lid be lifted to obtain access to the ball-cock. Once the water level in the tank is set, the adjustment is usually thereafter ignored. The same volume of water is therefore discharged from the tank every time that the flushing system is tripped, regardless of the volume which may be actually required to successfully flush the toilet.

It is a well known fact that the largest use of water in most households and in many office buildings is for flushing toilets. Because flushing is carried out with the full capacity of the water in the water tank, the water usage is wasteful and is not required. Considerable interest has been centered on reducing the water used when toilets are flushed, especially at times and in places when there is a water deficiency or periods of drought.

Several water saving methods have been used to conserve water during the toilet flushing operation. One such method has been to deposit a filled water bag or a solid object, such as a brick, in the water tank to displace an equivalent volume of water in the tank, to thus reduce the volume of water consumed with each flushing. Another common method is to lower the float valve to allow the ball-cock valve to close at a reduced water level. These methods to conserve water in many cases are self-defeating, in that, the effectiveness of the flush is diminished and it may be necessary to flush twice to effect a sanitary flush. Additionally, such methods represent a compromise in that the volume of water is set and is not readily adjustable.

Other flush saving methods have included modifying a flapper valve and/or a tank ball valve by inserting into the valve various types of foam fillers. An analysis of this method, conducted by the applicant, determined that only open-pore foam partially functioned; closed-pore foam would not work at all as the inside of the foam would not absorb the water. The analysis further disclosed the following.

The specific gravity of water is 1.00 while the specific gravity of the foam is between 0.96 and 1.0. Therefore, the foam modified valve is slightly over the specific gravity of water. The problem here is to be sure that the valve is completely filled with foam and that the foam is completely filled with water. If the smallest air space is present, the slight margin of weight is overcome and the valve will float, thus defeating the requirement for a quick closing valve. Further investigation revealed that the only way to completely fill the foam was by squeezing and releasing it under water. The foam never completely filled when installed (open side down) as air is trapped inside the valve and the foam sponge cannot fill without displacing the trapped air.

The investigation also revealed that often the valve remains "seated" in the water delivery port of the tank section for a period of time. When this period is approximately eight hours, the water drains out of the sponge and into the open space under the tank and the water pressure "head" deforms the valve to conform to the seat. This condition squeezes out some of the water in the sponge. With this additional loss of water the specific gravity of the valve is reduced to much less than water. Thus, when the valve is actuated after the seating period, the valve floats, defeating the water saving purpose of the invention. Once the water has drained out, the valve must be removed to refill the sponge because in the floating position, only half of the valve is submerged and the trapped air will not allow the sponge to refill. The specific gravity at this point, is less than 1.0 and therefore, the valve continues to float negating the water saving feature.

Solid foams were also checked and were determined not to be feasible. The tank valve seats are of two types: metal rings or "cast in" the porcelain. Both are subject to out-of-round conditions due to manufacturing tolerances and from nodules grown from the salts in the water. Both of these conditions require that the valve be soft enough to conform to the valve seat. When a solid foam is used, the weight of the foam interferes with the required deformation. The solid foam also presents the same problem, as stated above, in filling the solid foam completely and with the water draining out when the valve is closed for an extended period of time.

In addition to a foam insert, a loose metal weight may be inserted into a flapper valve or a tank-ball valve to render the valve non-buoyant. In this design concept, a quick closing valve is provided. However, most of these current valves require built-in rubber support, such as heavy ribs, to resist the weight of the water. Others depend on a thick rubber section over the tank drain. In all flapper type valves, the valve seat has a relatively sharp lip that forms the valve seal and the rubber deforms over this lip to form the seal. If the flapper valve deflects too far downward an inward-buckling deformation is formed in the center due to the weight of the water. Thus, the rubber seats on the inside of the valve rather than on the seat. This condition leads to unseen constant leaking.

A search of the prior art did not disclose any patents that read directly on the claims of the instant invention however, the following U.S. patents were considered related:

| U.S. PAT. NO. | INVENTOR | ISSUED | |
|---|---|---|---|
| 4,837,867 | Miller | 13 June | 1989 |
| 4,700,413 | Lopez | 20 October | 1987 |
| 4,483,024 | Troeh | 20 November | 1984 |
| 4,364,129 | Schonger | 21 December | 1982 |
| 4,268,924 | Price et al | 26 May | 1981 |
| 4,216,555 | Detjen | 12 August | 1980 |
| 2,769,457 | Wittenberg | 6 November | 1956 |

The Miller patent discloses a dual flush system for toilets to effect a full flush or a partial flush of the toilet to carry away liquid wastes. The system functions by partially opening the main valve, located in the water holding tank of the toilet, for a period of time that is determined by the operator. When the valve is opened slightly, downward pressure on the valve and suction forces the water passing between the valve and valve seat to exert a downward force on the valve that causes the valve to pull back into a closed position after opening. Only when the valve is raised to a position where its buoyancy exceeds the downward pressure is a full flush effected. The system includes the means to limit the upward lifting of the valve by limiting the lengthwise travel of a cord attached to the valve. The cord is attached on its other end to a flush handle and lever.

The Lopez patent discloses a toilet flushing mechanism that provides high and low water volume selectability. The invention consists of an articulated float arm that is normally bent at an angle by a detent mechanism to maintain a low water level in the toilet water tank. A linkage is provided to the exterior of the tank for releasing the detent mechanism. When so released, the buoyant float straightens the arm thereby admitting additional water into the tank to obtain a more vigorous flushing action.

The Troeh patent discloses a variable flush for a toilet water tank wherein the valve is operated by the same toilet trip lever as the usual single level types. The operational differences, presented by the invention, is that a light pressure on the toilet trip handle causes the two-level flush valve to yield a small flush whereas a heavier pressure will cause a full flush. The invention includes a first float connected to the outer end of the valve arm to maintain the valve in an open position until the water level falls below a predetermined level. A second float is carried on a float arm pivoted intermediate its ends to the support.

The Schonger patent discloses a toilet flush system that allows a user to manually control the amount of water used for a toilet flush. The system uses a modified flapper valve, a tank ball valve or other type valves to control the closing of a reservoir outlet at selected times prior to or upon completion of the normal flush cycle. The tank ball or flapper valve is modified to overcome its buoyancy such that it rapidly closes the tank reservoir to thereby terminate the flush cycle when the handle of the toilet is released. By maintaining the handle in the operated position, the individual flush cycle can be controlled dependent on the waste to be disposed of. The buoyancy of the valve is overcome by inserting a water absorbing material, such as a sponge, into the valve. when the valve is primed, the sponge increases the weight of the valve.

The Price patent discloses a toilet flushing apparatus that incorporates an inventive water control valve that is used in a syphon-operated closet bowl flush tank having an inverted bell containing a liftable plunger disc to initiate syphon action The valve allows a user to select between a light or a heavy flush. A light flush is derived from an initial operation followed by a quick release. A heavy flush is derived from an initial operation which is then sustained. To fit the valve to an existing inverted bell, a hole is cut into the top of the bell and the valve is lowered through the hole.

The Detjen patent discloses a dual-flush toilet system that provides either a full flush or a partial flush at the option of the user. When a full flush is desired, the flush handle is actuated normally; if a partial flush is desired, the handle is held in a depressed condition for two to three seconds. The partial flush is produced when a buoyant reseating weight floats down with the falling level of the liquid in the tank. The weight depresses the flush ball and prematurely reseats in its outlet seat when only part of the liquid has been discharged from the tank. The reseating weight is provided with a latch actuated by the flush handle. For a full flush, the latch is released but is immediately re-engaged before the reseating weight moves downwardly in the tank.

The Wittenberg patent discloses a combined venting and overpressure release valve that uses a metallic weight for the purpose of biasing the valve operation. The valve is designed to seat on an aperture located in the surface of a pressure vessel. When sufficient pressure accumulates in the vessel, the valve opens to relieve dangerous overpressure conditions.

DISCLOSURE OF THE INVENTION

The improved toilet-tank flapper valve allows a toilet user to easily select the quantity of water that will be used to flush the toilet. If liquid waste is to be flushed, only a partial flush is necessary. Only when disposing of solid waste is a full flush necessary.

Conventional toilet water tanks are designed to hold from three to eight gallons of water. In a family of four, it has been estimated that 20,000 gallons of fresh water could be saved yearly if the average flush were limited to between 2 and 2.5 gallons per flush. By installing the improved toilet-tank flapper valve in a toilet flushing system, this average can be maintained. Additionally, this water savings, when multiplied by the hundreds of toilets used in any given community would greatly reduce the burden on the communities water resources and help to reduce the overload in sewers and septic tanks.

The improved toilet-tank flapper valve is designed to replace a conventional flapper valve or tank-ball valve without any modification to the water tank or the valve attachment means. The improved valve includes a cavity that is substantially centered over the toilet tank drain. Into this cavity is inserted a weight that then causes the valve to overcome the specific gravity of water which allows a user to control the time the valve will remain open to thus, control the toilet flush.

All conventional rubber valves have a tendency to "curl up" from the lifting chain connected between the valve and the toilet flush handle and assume a permanent concave or "rocker" shape. This condition allows water to leak during the early filling of the toilet tank until the weight of the water bends the valve against the valve seat to provide a seal.

The weight inserted into the improved valve remedies this initial leakage condition by producing a flat rigid section over the area of the valve body that extends radially over and beyond the perimeter of the valve seat. This stiffened section allows the interfacing surface of the valve with the valve seat to produce a valve seat seal that remains substantially flat for the life of the valve and that provides a valve seal before the tank begins to fill.

To operate a toilet flushing system incorporating the improved flapper valve, the flush handle on the toilet tank, which is mechanically linked to the flapper valve, is depressed to allow the valve to lift from the valve seat and commence the flush. The handle is held in the depressed position for a period of time that is selected by the user and is dependent upon the type of waste that is to be flushed. For liquid waste, a time period of 2 seconds is recommended while for disposing of solid waste a time period of 4 seconds is used to effect a full flush.

In view of the above disclosure, it is the primary object of the invention to provide an improved toilet-tank flapper valve that saves water by allowing the toilet user to selectively determine the amount of water that is to be used for a specific toilet flush.

In addition to the primary object, it is also an object of the invention to provide a flapper valve that:

- saves water while retaining the effectiveness of the flush,
- requires no skill or special tools to install,
- requires no adjustments and/or periodic service,
- is sufficiently light to allow children and older people to activate the valve with little force,
- provides a flat, smooth and soft sealing surface,
- can be used to modify existing toilets or can be built-in to newly manufactured toilets,
- is simple to use,
- is cost effective from both a manufacturing and consumer viewpoint,
- does not require any modifications to the toilet water tank or toilet bowl.

These and other objects and advantages of the instant invention will become apparent from the subsequent detailed description of the preferred embodiment and the appended claims taken in conjunction with the accompanying drawings.

BEST MODE FOR CARRYING OUT THE INVENTION

Figure 1:
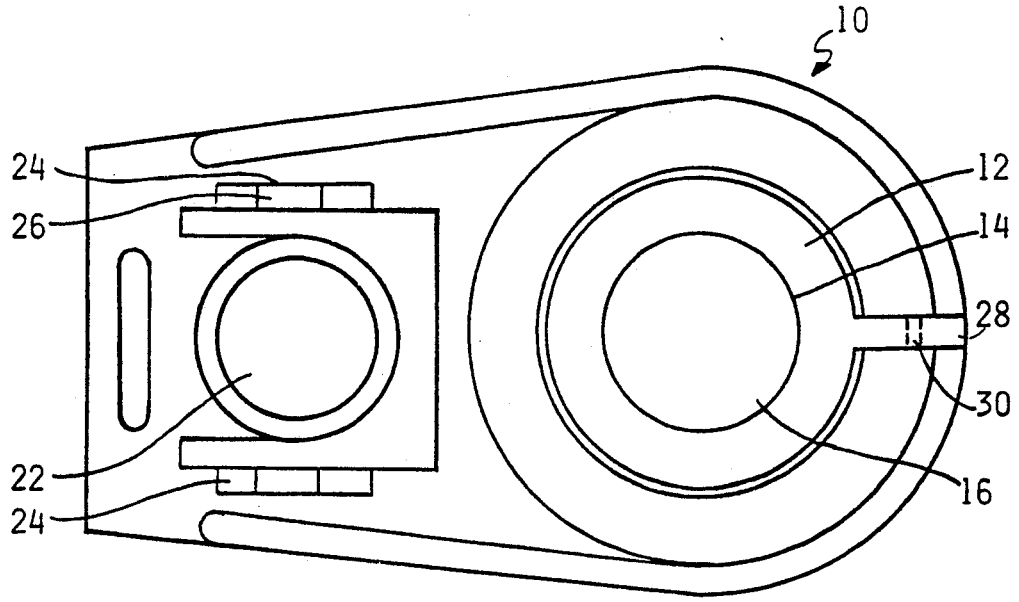
FIG. 1 is a top plan view of the improved flapper valve.

The best mode for carrying out the improved toilet-tank flapper valve 10 is presented in terms of a preferred embodiment that is designed to allow a toilet user to manually select the quantity of water used for a toilet flush. The quantity of water selected is dependent upon the type of waste that is to be disposed; for liquid waste, a partial flush is recommended while for solid waste, a full flush would be used. The quantity of water available for the toilet flush is controlled by the user by first depressing and holding the flush handle to commence the flush and then releasing it to terminate the flush.

The improved valve 10, as shown in FIGS. 1 through 6, is designed to directly replace either a conventional toilet flapper valve or tank ball valve and to operate in combination with a conventional toilet flushing system consisting of a toilet water tank 30 and a toilet bowl 40. The tank 30 includes on its bottom surface 32 a toilet tank drain 34 having a valve seat 36 and further includes a flush handle 38 that is connected, via a mechanical linkage 50, to an attachment point on the valve 10. The flush handle 38 allows a toilet user to manually control the time the valve remains in the open position of the valve 10. The tank 30 is attached to the bowl 40 by interfacing the toilet tank drain 32 with a bowl drain 42 located on the upper surface of the bowl 40. When a toilet flush occurs, the flush water from the tank 30 flows into the toilet bowl, from where the water and waste is routed into a sewer system or septic tank.

The improved flapper valve 10, as shown in FIGS. 1–5 consists of a resilient valve body made of a neoprene rubber or any other material having a durometer scale between 35 and 45. By using a resilient material, the bottom surface 18 of the valve 10 is able to conform to the shape of the valve seat 36 to provide a good seal without permanent deformation.

Figure 3:
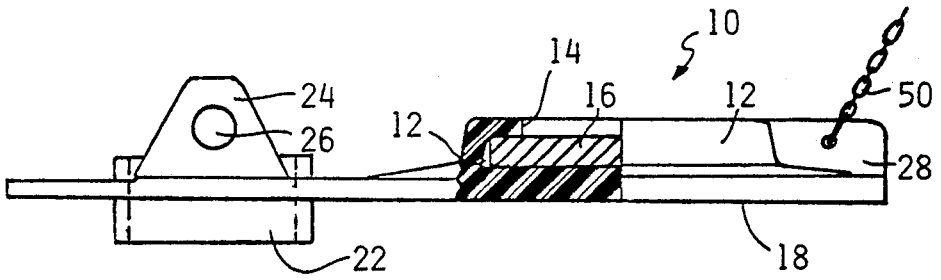
FIG. 3 is a side elevational view of the valve that include a partial cut-away section showing the weight enclosed within the valve cavity.
Figure 2:
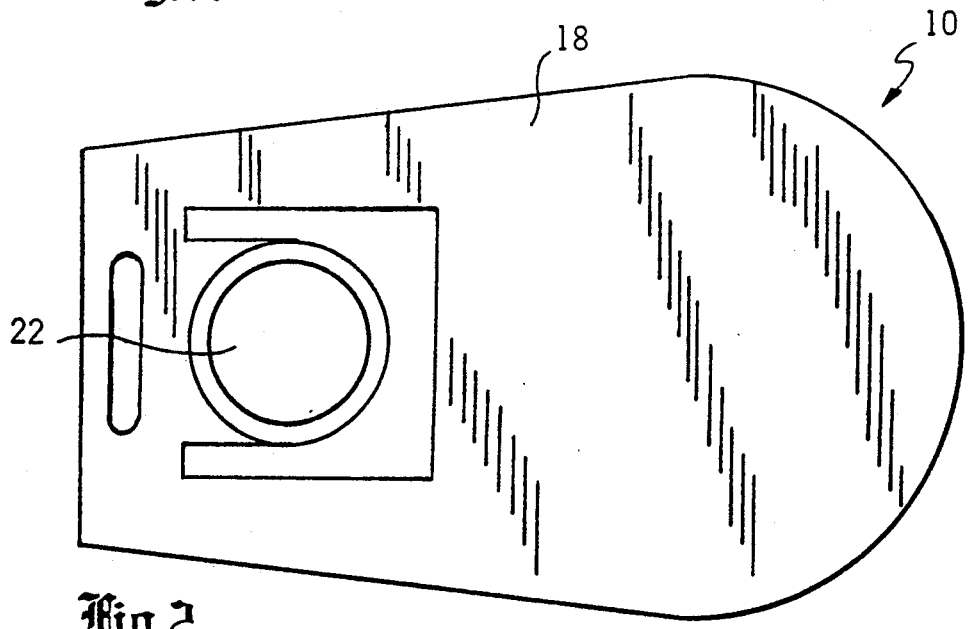
FIG. 2 is a bottom plan view of the valve.
Figure 4:
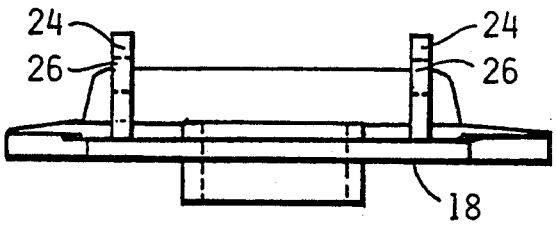
FIG. 4 is a back elevational view of the valve.
Figure 6:
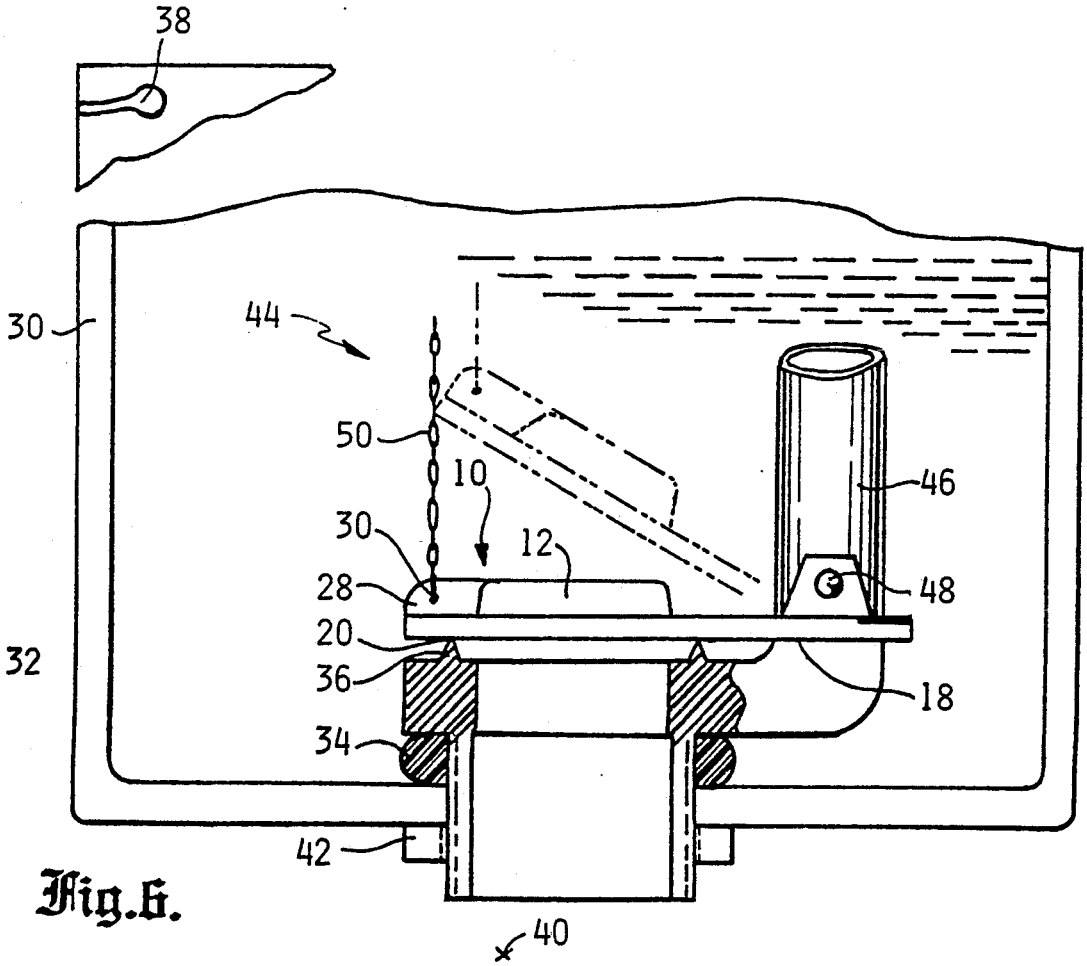
FIG. 6 is an elevational view of a conventional toilet flushing system utilizing the improved flapper valve. The valve is shown in the closed position in solid lines and in the open position in phantom lines.

On the upper surface of the valve 10, as best shown in FIGS. 1 and 3, is located an upwardly extending cavity 12. As shown in FIG. 6, the cavity is substantially centered over the valve seat 36. In the preferred embodiment, the cavity is in a circular shape and has an area that covers approximately 47 percent of the area of the water drain. Around the upper perimeter edge of the cavity 12 is a contiguous inwardly projecting edge 14 that helps retain a weight 16 as described infra.

The valve 10 has sufficient weight to allow the valve to automatically drop into its closed position by the force of gravity. In other words, the valve has a specific gravity greater than that of water. To provide the requisite weight, a weight 16 is sized to fit into and be retained within the cavity 14 by a weight retaining means. This means, in the preferred embodiment, consists of the inwardly projecting edge 14 as best shown in FIG. 3. The weight can be made of any material that has a specific gravity greater than that of water. Brass which has a specific gravity of 8.4 is preferred. However, lead with a specific gravity of 11.3, zinc with a specific gravity of 7.1 or irons with specific gravities between 7.0 to 7.9 may also be used. In general, a weight weighting between 1.5 to 2.5 ounces (42.5 to 70.9 grams) will function. The substantial difference between the weight and the water insures that the valve will effectively close quickly.

To allow the toilet flushing system to function properly it is essential that the valve 10 close quickly as the water in the tank 30 will totally empty in approximately four seconds. Therefore, in order to save water, the valve must close in less than 0.25 seconds. If not, the valve will either float down or slowly sink, wasting water. In testing the valve 10 it was found that because of the weight/water ratio it closed at a speed of 0.1 seconds.

One of the important design parameter and novelties of the valve 10 is embodied in the fact that the weight 16, which preferably has a diameter of 1.375 inches (3.53 cm), causes the section of the resilient valve body, located under the weight, to have a flat rigid section 18 or bridge that extends radially over and beyond the perimeter of the valve seat 36. Thus, the interfacing surface of the valve 10 with the valve seat 36 produces a valve seat seal 20 that is substantially flat and free of any inward-buckling deformation. This type of deformation may lead to unseen constant leaking as described in the BACKGROUND ART section.

As previously mentioned, the improved flapper valve 10 is directly replaceable with either a conventional toilet flapper valve or tank ball valve. The valve includes a means for swivelly attaching the valve to a toilet flushing apparatus 44 located inside the toilet water tank 30. Two such attaching means, as best shown in FIGS. 1 and 3, are provided with the selection dependent on the design of the toilet flushing apparatus 44. The first consists of an attachment bore 22 that is sized to slide over an airflow tube 46 which comprises an element of the apparatus 44. The second consists of a pair of upwardly extending attachment ears 24 that each have a bore 26 therethrough. The bores are slipped into a respective pair of projecting arms 48 that are located on the apparatus 44.

Figure 5:
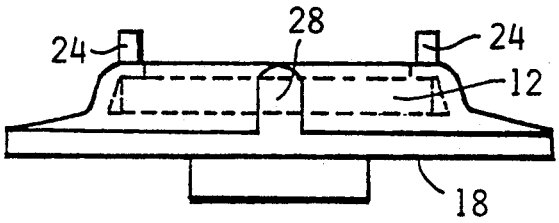
FIG. 5 is a front elevational view of the valve.

The final structural element of the valve 10 is a flush handle attachment structure 28 having a bore 30 therethrough. The structure 28 as shown in FIGS. 3 and 5, is centrally located on the inward end of the valve and has attached to its bore 30 one end of a mechanical linkage 50 where the other end of the linkage is attached to the end of the flush handle 38. As shown in FIG. 6, the mechanical linkage preferably consists of either a vinyl beaded chain or metal chain 52. When the flush handle 38 is depressed, the valve 10 is lifted and held above the valve seat 36, for a period of time selectable by the user, to allow the water in the toilet water tank 30 to drain out through the tank drain 34 and into the toilet bowl 40 to thus effect a controlled toilet flush.

OPERATION

To operate a toilet flushing system incorporating the improved flapper valve 10, the following steps are performed:

1. to commence a toilet flush, depress the toilet flush handle 38 to cause the valve 10 to lift from the valve seat 36,
   - to dispose liquid waste, depress handle 38 for approximately two seconds to effect a partial flush,
   - to dispose solid waste, depress handle 38 for approximately four seconds to effect a full flush,
2. release the toilet flush handle 38 after the expiration of the above selected time period to allow the valve 10 to drop and seal against the valve seat 36.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. An improved toilet-tank flapper valve comprising:

a) a resilient body having an upwardly extending cavity substantially centered over the valve seat of a toilet tank drain located inside a toilet water tank, b) a weight sized to fit into and be retained within said cavity by a weight retaining means, where said weight causes the section of the resilient body located under said weight to have a flat rigid section that extends radially over and beyond the perimeter of the valve seat so that the interfacing surface of said valve with the valve seat produces a valve seat seal that remains substantially flat, c) means for swivelly attaching said valve to a toilet flushing apparatus located inside the toilet water tank, and d) means for attaching said valve to a toilet flush handle located on the toilet water tank where when the handle is depressed said valve rises to commence a toilet flush.

2. The improved toilet-tank flapper valve as specified in claim 1 wherein said valve is constructed of a resilient material that allows said valve to conform to the shape of the valve seat without permanent deformation.

3. The improved toilet-tank flapper valve as specified in claim 2 wherein said valve is constructed of neoprene rubber.

4. The improved toilet-tank flapper valve as specified in claim 1 wherin said weight retaining means comprises an inwardly projecting edge on said cavity that retains said weight captive within said cavity.

5. The improved toilet-tank flapper valve as specified in claim 1 wherein said cavity is in a circular shape and has an area that covers approximately 47 percent of the area of the water drain.

6. The improved toilet-tank flapper valve as specified in claim 1 wherein said weight has sufficient weight to allow said valve to close by the force of gravity.

7. The improved toilet-tank flapper valve as specified in claim 6 wherein said weight weighs between 1.5 to 2.5 ounces (42.5 to 70.9 grams).

8. The improved toilet-tank flapper valve as specified in claim 1 wherein said valve has a specific gravity greater than that of water.

9. The improved toilet-tank flapper valve as specified in claim 1 wherein said valve closes in less than 0.25 seconds after the release of the toilet flush handle.

* * * * *